US005337909A

United States Patent [19]

Vailliencourt

[11] Patent Number: 5,337,909

[45] Date of Patent: Aug. 16, 1994

[54] HOT FILL PLASTIC CONTAINER HAVING A RADIAL REINFORCEMENT RIB

[75] Inventor: Dwayne Vailliencourt, Manchester, Mich.

[73] Assignee: Hoover Universal, Inc., Plymouth, Mich.

[21] Appl. No.: 16,635

[22] Filed: Feb. 12, 1993

[51] Int. Cl.[5] ..... B65D 1/02; B65D 1/42; B65D 23/08

[52] U.S. Cl. ..... 215/1 C; 40/310; 220/609; 220/672; 220/675

[58] Field of Search ..... 215/1 C, 100 A; 40/310; 220/672, 675, 606, 609

[56] References Cited

U.S. PATENT DOCUMENTS

| | | | |
|---|---|---|---|
| 4,497,855 | 2/1985 | Agrawal et al. | 215/1 C X |
| 4,749,092 | 6/1988 | Sugiura et al. | 215/1 C |
| 4,805,788 | 2/1989 | Akiho et al. | 215/1 C |
| 4,863,046 | 9/1989 | Collette et al. | 215/1 C |
| 5,054,632 | 10/1991 | Alberghini et al. | 220/675 X |
| 5,064,081 | 11/1991 | Hayashi et al. | 220/675 X |
| 5,067,622 | 11/1991 | Garver et al. | 215/1 C |
| 5,178,289 | 1/1993 | Krishnakumar et al. | 220/673 X |

FOREIGN PATENT DOCUMENTS

| | | | |
|---|---|---|---|
| 423406 | 4/1991 | European Pat. Off. | 215/1 C |

*Primary Examiner*—Sue A. Weaver

*Attorney, Agent, or Firm*—Leonard J. Kalinowski; E. L. Levine; Joseph E. Root, III

[57] ABSTRACT

A container of a heat set plastic material adapted for hot fill applications includes a plurality of elongated vertically oriented vacuum panels in its sidewall and first and second circumferentially extending inwardly directed reinforcement ribs which are located in the label mounting areas above and below the vacuum panels and which cooperate with upper and lower label bumpers of the container to support the upper and lower edges of the vacuum panels permitting the center portions of the panels to flex inward during filling and sealing the container with a hot liquid, but resisting deformation of the container sidewall in compensating for the hot-fill vacuum.

12 Claims, 3 Drawing Sheets

HOT FILL PLASTIC CONTAINER HAVING A RADIAL REINFORCEMENT RIB

BACKGROUND OF THE INVENTION

This invention relates to hot-fill plastic or polyester containers, and more particularly to such a container having an improved sidewall construction.

In the past, most plastic or polyester containers were used to contain liquids that are initially dispensed at room temperature or chilled. However, in recent years, there has been a significant increase in the demand for polyester containers for packaging "hot fill" beverages. "Hot-fill" applications impose additional mechanical stresses on the container structure which cause the container to be less resistant to deformation when the container is being handled or if it is dropped. The thin sidewalls of conventional polyester containers deform or collapse at hot fill temperatures. Moreover, the rigidity of the container decreases immediately after the "hot-fill" liquid is introduced into the container, making the container more susceptible to failure due to mechanical stresses. As the hot-filled liquid cools, it shrinks in volume which has the effect of producing a negative pressure or "hot-fill" vacuum in the container. The container must be able to sustain such internal pressure changes while maintaining its configuration.

Various methods have been devised to counter thermal instabilities. One method broadly involves heat treating the polyester to induce molecular changes which will result in a container exhibiting thermal stability. Other methods involve forming the polyester structure into a structural configuration which can maintain stability during hot fill. Thus, the hot-fill containers being produced have a generally cylindrical main body which is provided with a plurality of elongated vertically oriented panels. These panels, which are commonly referred to as pressure or vacuum panels, are designed to collapse inwardly after the container has been filled with a hot liquid so as to accommodate the inevitable volume shrinkage of the liquid in the container as the liquid cools. However, the inward flexing of the panels caused by the hot fill vacuum creates high stress points at the top and bottom edges of the pressure panels, and especially at the upper and lower corners of the panels. These stress points weaken the portions of the sidewall near the edges of the panels, allowing the sidewall to collapse inwardly during handling of the container or when containers are stacked together.

This problem could be alleviated by increasing the thickness of the container wall. However, increasing the wall thickness results in an increase in material cost for the container and in the weight of the finished container, which results are not acceptable to the container industry. The effects of hot-fill stresses can be minimized by providing pressure panels which extend substantially the entire vertical length of the sidewall and with longitudinally extending ribs extending along the edges of the panels. Examples of containers of this type are shown in U.S. Pat. Nos. 4,805,788 and 4,863,046. The hot-fill container disclosed in U.S. Pat. No. 4,863,046, for example, has a cylindrical main body portion which includes a plurality of vertically oriented pressure panels separated by vertically elongated land areas. The pressure panels extend from just below the label upper bumper to just above the lower label bumper. The vertically elongated land areas between the pressure panels are reinforced by vertical ribs. Each of the pressure panels includes a plurality of transverse, horizontally extending radially recessed rib segments within the panel which ensure that the panel moves uniformly. Because the pressure panels extend from just below the upper label bumper to just above the lower label bumper, the area for securing the label to the container body is minimized. This imposes significant constraints on the manufacturing tolerances in applying the label to the container. Label placement is critical because the areas above and below the panels for placement of the upper and lower edges of the label are relatively small. Moreover, because the size of the panels is large relative to the label bearing portion of the sidewall, there is a minimal flat cylindrical area for securing the label to the container.

Another container construction for hot-fill applications, which is disclosed in U.S. Pat. No. 5,067,622, has its sidewall rigidized by a plurality of concentric rings which prevent inward flexing of the sidewall. The container includes a plurality of small vacuum panels in the neck portion of the container. The vacuum panels in the neck portion of the container and a vacuum panel in the base of the container permit the container to deflect under hot fill and subsequent vacuum conditions. However, the body portion does not undergo either radial or longitudinal contraction, and the vacuum panels work independently of the sidewall reinforcement. Moreover, this construction results in a minimal flat cylindrical sidewall area for receiving the upper and lower edges of the label so that label placement is critical.

Another hot-fill container, which is disclosed in U.S. Pat. No. 4,749,092, includes a sidewall portion which contains a plurality of pressure panels and a smooth surfaced cylindrical portion, which is located above the pressure panels, which is adapted for affixation of a label. In one embodiment, the label receiving portion includes annular grooves which reinforce only the label receiving portion of the container, and the label does not cover the pressure panels.

SUMMARY OF THE INVENTION

The present invention provides a thin-walled plastic container formed from a heat set plastic material which is adapted for hot-fill applications and which includes a plurality of vacuum panels which are adapted to flex inwardly due to filling the container with a hot-fill liquid, sealing the container and subsequent cooling of the liquid. In accordance with the invention, at least one of the label mounting areas above and below the vacuum panels, and preferably both label mounting areas, include annular reinforcement ribs which extend continuously around the circumference of the container sidewall. The reinforcement ribs support the vacuum panels at their upper and lower edges, holding the edges of the panels fixed, while permitting the center portions of the vacuum panels to flex inwardly under hot fill and subsequent vacuum conditions and resisting deformation of the vacuum panels subsequent to inward flexing of the vacuum panels due to filling and sealing of the container. In addition, this reinforcement of the vacuum panels enables the container to resist sidewall deformation during handling of the container or when containers are stacked. The reinforcement ribs are located in the label upper and lower mounting areas, spaced from the edges of the vacuum panels but located closer to the edges of the panels than to the upper and lower edges of the label upper and lower mounting areas. In another embodiment, the reinforcement ribs merge with the edges of the vacuum panels at the edge of the label upper and lower mounting panels. The provision of reinforcement ribs which support the vacuum panels at their upper and lower edges permits smaller size vacuum panels to be used for a given size container, so that the size of the upper and label lower panels can be maximized for a given size container. Because the size of the label upper and lower mounting panels is maximized, label placement is less critical, resulting in more flexibility in the process for applying the label to the container.

DESCRIPTION OF A PREFERRED EMBODIMENT

Figure 1:
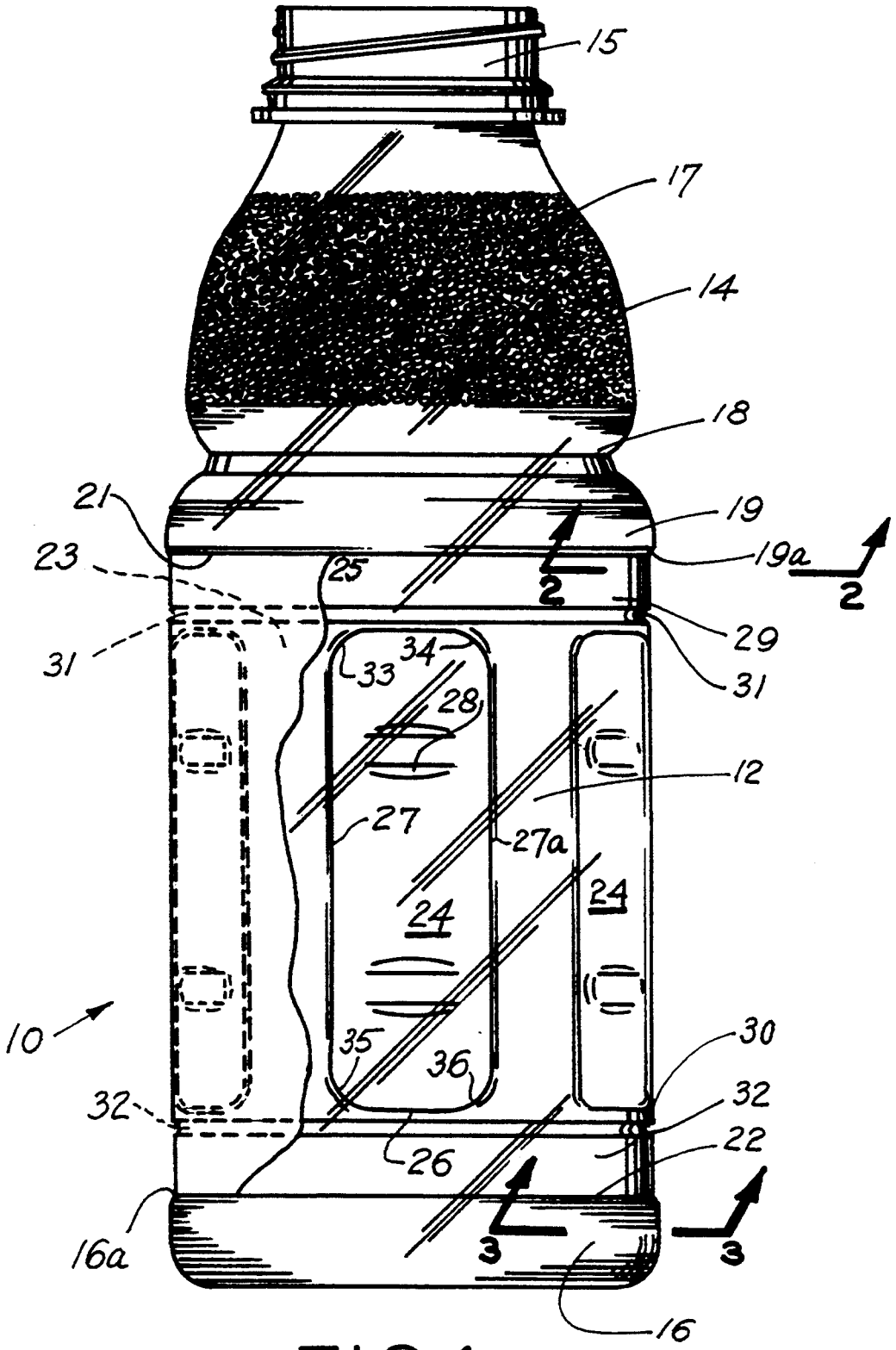
FIG. 1 is an elevation view of a container provided by the present invention.

Referring to the drawings, the container of this invention, indicated generally at 10, is illustrated in FIG. 1 as having a main sidewall portion 12 of generally round cylindrical shape, an upper portion 14 defining a sealable closure 15, and a base portion 16 closing the bottom of the container. The sidewall portion 12 is formed integrally with and extends between the upper portion 14 and the base portion 16. The upper portion 14, which is located between the sidewall portion 12 and the closure 15, includes a generally dome shaped portion 17, a necked down portion 18 and an annular shoulder 19. The annular shoulder 19, which is located at the transition between the container sidewall 12 and the upper portion 14 of the container, has a lower edge 19*a* which is offset relative to the sidewall, defining an upper label bumper 21. Similarly, at the transition between the container sidewall 12 and the base portion 16 of the container, the annular upper edge 16*a* of the base portion 16 is offset relative to the sidewall, defining a lower label bumper 22. A full wrap label 23 is applied to the container sidewall portion 12 between the upper and lower label bumpers and is secured to the sidewall in a suitable manner as is known in the art.

The container 10 is a "hot-fill" container which is adapted to be filled with a liquid at a temperature above room temperature. The container is formed in a blow mold and is produced from a polyester or other plastic material, such as a heat set polyethylene terephthalate (PET). The sidewall portion 12 includes a plurality of vertically elongated oriented vacuum panels 24 which are disposed about the circumference of the container, spaced apart from one another by smooth, elongated vertically land areas 38. Each of the panels is generally rectangular in shape and has an upper edge 25, a lower edge 26, and side edges 27 and 27*a*. The vacuum panels are adapted to flex inwardly due to filling the container with a hot-fill liquid, capping the container, and subsequent cooling of the liquid. In addition, the base portion 16 may be adapted to deflect upwardly and inwardly in response to the hot fill process as is known in the art. During the hot fill process, the vacuum panels 24 of container 10 operate in conjunction with the base portion 16 to compensate for the hot fill vacuum. The vacuum panels 24 may contain one or more transverse ribs 28 which serve to strengthen the panels 24 against deformation during fabrication and under evacuation.

The sidewall portion which extends between the upper label bumper and the lower label bumper is commonly referred to as the label panel which includes flat surfaces which facilitate securing the label 23 to the container. The vacuum panels 24 are located in the label panel between the upper label bumper 21 and the lower label bumper 22, and thus are covered by the label 23. The marginal area 29 between the upper edges 25 of the vacuum panels and the upper label bumper 21 defines a flat label upper mounting panel and the marginal area 30 between the lower edges 26 of the vacuum panels 24 and the lower label bumper 22 defines a flat label lower mounting panel. For one twenty ounce container which was produced having an outer diameter of 2.75 inches, the length of the vacuum panels was approximately 2.75 inches and the vertical length of the label upper mounting area was approximately 0.5 inch and the vertical length of the lower label mounting area was approximately 0.5 inch. The label 23 has its upper and lower edges glued to the upper and label lower mounting panels in the conventional manner.

In accordance with the present invention, the container sidewall portion 12 includes two inwardly directed reinforcement ribs 31 and 32. One of the reinforcement ribs 31 is located in the label upper panel 29 between the upper edges 25 of the vacuum panels 24 and the upper label bumper 21, but closer to the panel upper edges 25 than to the upper label bumper 21. The other reinforcement rib 32 is located in the label lower panel 30 between the lower edges 26 of the vacuum panels 24 and the lower label bumper 22, but closer to the panel lower edges 26 than to the lower label bumper 22. The annular reinforcement ribs 31 and 32 are continuous and extend around the inner circumference of the sidewall.

Figure 4:
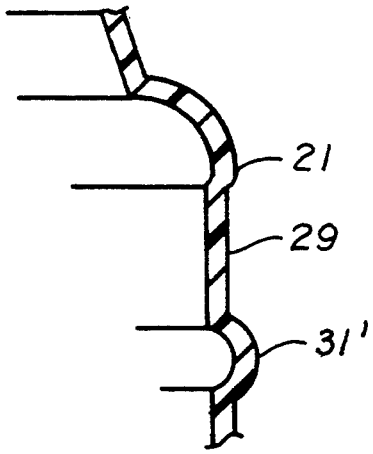
FIG. 4 is a view similar to FIG. 2, but illustrating the reinforcement rib directed outwardly.
Figure 2:
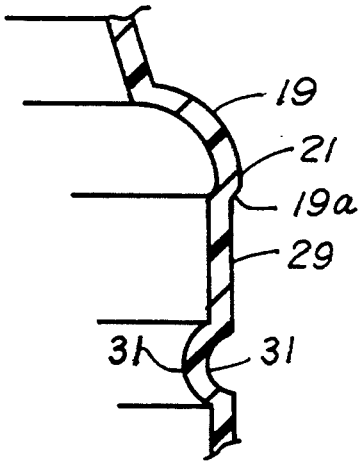
FIG. 2 is an enlarged vertical sectional view taken along the lines 2—2 of FIG. 1.
Figure 3:
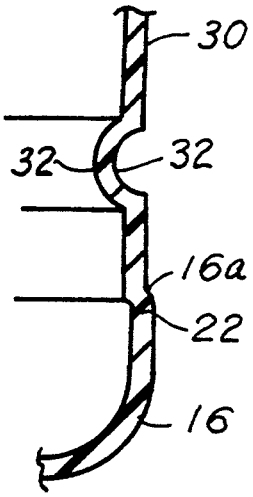
FIG. 3 is an enlarged vertical sectional view taken along the lines 3—3 of FIG. 1.

Referring to FIGS. 2–4, the reinforcement ribs 31 and 32 each are generally semicylindrical in shape and are directed radially inward, as illustrated in FIGS. 2–3, relative to the portions of the sidewall which define the upper label mounting area 29 and the lower label mounting area 30. However, one or both of the reinforcement ribs may be directed outwardly in the manner of reinforcement rib 31′ shown in FIG. 4. As illustrated in FIG. 2, the lower end 19*a* of the shoulder 19 is offset relative to the surface of the upper label mounting area 29, defining the upper label bumper 21. Similarly, the upper end 16*a* of the base 16 is offset relative to the surface of the lower label mounting area 30, defining the lower label bumper 22. The annular ribs 31 and 32 are rigid and do not expand or contract under vacuum conditions. For one twenty ounce container which was produced having an outer diameter of 2.75 inches, the radius of each of the reinforcement ribs 31 and 32 was approximately 3/64 inches. The center line of the reinforcement rib 31 was located approximately 7/64 inch from the upper edge 25 of the vacuum panels. The centerline of the reinforcement rib 32 was located approximately 7/64 inch from the lower edge 26 of the vacuum panels. The size of the reinforcement ribs 31 and 32 is a function of the size of the container, and by way of example, would be increased from the value given in proportion to an increase in the dimensions of the container from the dimensions given for the exemplary container 10.

The reinforcement ribs support the vacuum panels at their upper and lower edges. This permits smaller size vacuum panels to be used for a given size container, so that the size of the upper and label lower panels is increased for a given size container. Because of the increased size of the label upper and lower mounting panels, label placement is not critical resulting in more flexibility in the process for applying the label to the container. A secondary benefit is that the reinforcement ribs rigidize the side wall at the top and bottom edges of the vacuum panels 24. This makes the container sidewall, including the vacuum panels, less susceptible to deformation in shipping and handling of the container.

Figure 7:
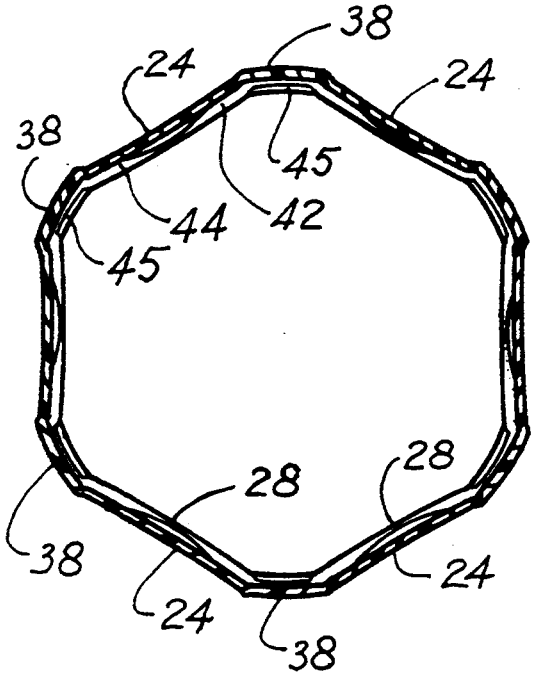
Figure 6:
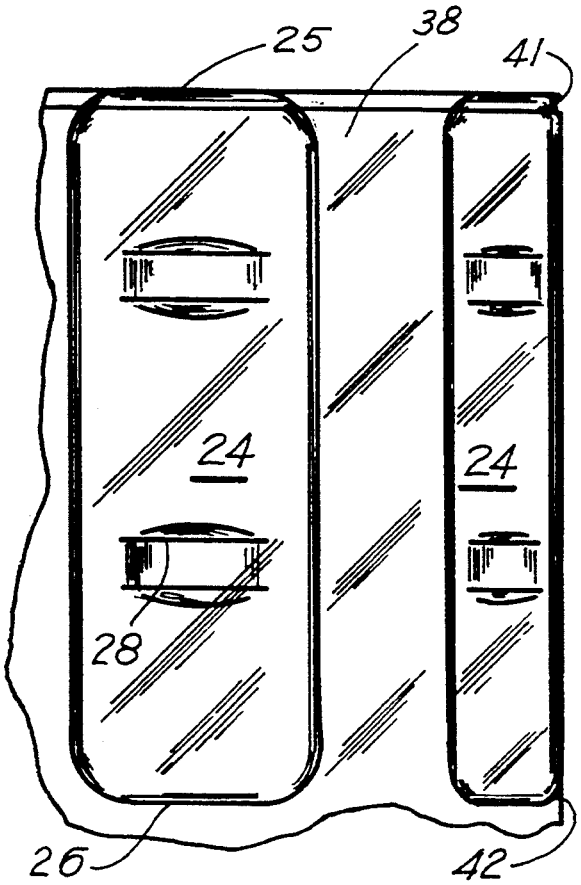
FIG. 6 is an enlarged fragmentary view of a portion of the container illustrated in FIG. 5; and, FIG. 7 is a transverse sectional view taken along the lines 7—7 of FIG. 5, but rotated 30 degrees.
Figure 5:
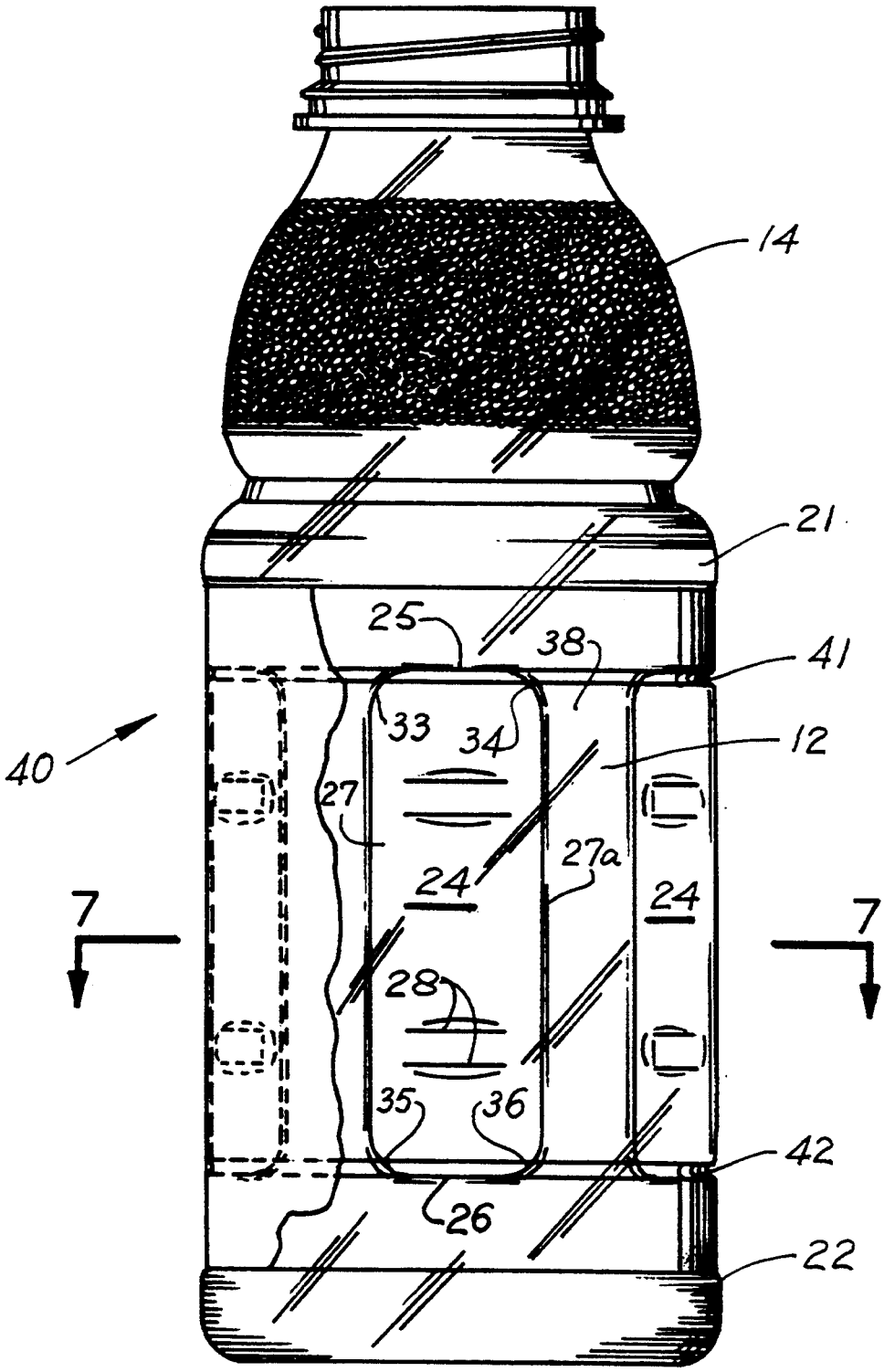
FIG. 5 is an elevation view of a container provided in accordance with a second embodiment of the present invention.

The inward flexing of the vacuum panels 24 caused by the hot fill vacuum creates high stress points, at the top corners 33 and 34 of the vacuum panels 24 and at the bottom corners 35 and 36 of the vacuum panels 24, which otherwise would flex inwardly, causing the container sidewall to collapse. The radial reinforcement ribs 31 and 32 which are molded concentric with the label upper panel 29 and the label lower panel 30 support the vacuum panels along their upper and lower edges, holding the edges fixed while permitting the center portions of the vacuum panels 24 to flex freely inward and without deforming the panels so that the vacuum panels operate in conjunction with the base 16 to allow the container to contract somewhat in volume during the "hot-fill" process to compensate for the volume shrinkage of the "hot-fill" liquid as the liquid cools. In addition, the reinforcement ribs strengthen the cylindrical portions of the sidewall between the panel upper and lower edges and the label upper and lower bumpers, enabling the upper and lower label mounting areas to resist the vacuum deformation, Referring to FIGS. 5–7, in accordance with a further embodiment, a container 40 has integrally molded reinforcing ribs 41 and 42 which merge with the upper edges 25 and the lower edges 26 of the vacuum panels 24. More specifically, reinforcing rib 41, which is molded integrally with the upper edges 25 of the vacuum panels 24, extends circumferentially across the flat areas 38 of the sidewall between each of the panels and merges with the upper edge 25 of each of the vacuum panels. Similarly, reinforcement rib 42, which is molded integrally with the lower edges 26 of the vacuum panels 24, extends circumferentially across the flat areas 38 of the sidewall between the panels and merges with the lower edge 26 of each of the vacuum panels. As shown in FIG. 7, the portions 44 of the reinforcement rib 42 which are adjacent the vacuum panels 24 are located radially inwardly relative to the portions 45 of the reinforcement rib 42 that are located in the flat, vertically extending areas 38 between the vacuum panels 24. The reinforcement rib 41 has the same configuration as reinforcement rib 42. Thus, the reinforcement ribs 41 and 42 have a scalloped appearance or configuration.

The effect of the reinforcement ribs 41 and 42 is the same as that provided by the reinforcement ribs 31 and 32 of container 10 illustrated in FIGS. 1–3. The reinforcement ribs 41 and 42 support the vacuum panels 24 at their upper and lower edges and rigidize the sidewall portion of the container 40 at the upper edges 25 and the lower edges 26 of the vacuum panels 24, preventing the sidewall from collapsing inwardly while permitting the vacuum panels 24 to operate in conjunction with the base portion 16 of the container to compensate for the volume shrinkage of the hot-fill liquid as the liquid cools.

Thus, it can be seen that the present invention provides a plastic container for hot-fill applications which has an improved sidewall construction afforded by annular inwardly directed reinforcement ribs which support the upper and lower edges of the vacuum panels. This reinforcement allows the vacuum panels to deflect under hot fill and subsequent vacuum conditions and operate in conjunction with the container base to compensate for volume shrinkage of the hot fill liquid, while resisting deformation of the vacuum panels subsequent to inward flexing of the vacuum panels due to filling and sealing of the container. In the accordance with preferred embodiments, the reinforcement ribs are located in the label upper and lower mounting panels, spaced from the edges of the vacuum panels or merging with the edges of the vacuum panels. However, it is within the scope of the present invention that the sidewall may include only one reinforcement rib, located in the label lower mounting cylinder or in the label upper mounting cylinder and either spaced apart from the edges of the vacuum panels or merging with the edges of the vacuum panels. Moreover, more than one reinforcement rib may be provided in one or both of the label upper and lower mounting panels. In addition, although the reinforcement ribs are illustrated in the preferred embodiments as being semicircular in shape, the reinforcement ribs could have other geometrical shapes and may be directed radially outward.

The invention has been described with reference to a preferred embodiment and is not limited to the exact construction or method illustrated, it being understood that various changes and modifications may be made without departing from the spirit, or scope of the invention as defined in the following claims.

I claim:

1. A thin-walled container formed from a heat set plastic material and adapted to be filled with a liquid at a temperature elevated above room temperature and then sealed, said container comprising: an upper portion which includes a sealable closure and an upper walled portion, a lower portion including a base closing the bottom of the container, and a sidewall portion which is generally tubular in shape and being formed integrally with and extending between said upper walled portion and said lower portion, said sidewall portion including a plurality of elongated vertically oriented vacuum panels which are adapted to flex inwardly upon a lowering of internal pressure during cooling of said liquid, each of said vacuum panels having an upper edge, a lower edge, and a panel portion intermediate said upper and lower edges, said upper edges of said vacuum panels being spaced apart from said upper walled portion defining an upper label mounting area above said vacuum panels, and said lower edges of said vacuum panels being spaced apart from said lower portion defining a lower label mounting area below said vacuum panels, and reinforcement means including at least one annular reinforcement rib located in one of said label mounting areas, said reinforcement rib being directed radially inward and extending continuously around the circumference of said sidewall portion and merging with the edges of said panels which are located adjacent to said one label mounting area, said reinforcement rib supporting said vacuum panels along at least one of their edges to hold said supported edges fixed while permitting said panel portions intermediate said edges of said panels to flex inwardly upon a lowering of internal pressure during cooling of said liquid and resisting deformation of said vacuum panels subsequent to inward flexing of said vacuum panels after filling and sealing of the container.

2. The container according to claim 1, wherein said reinforcement means includes first and second reinforcement ribs, and said first and second reinforcement ribs merge with the upper and lower edges, respectively, of said panels.

3. A thin-walled container formed from a heat set plastic material and adapted to be filled with a liquid at a temperature elevated above room temperature and then sealed, said container comprising: an upper portion which includes a sealable closure and an upper walled portion, a lower portion including a base closing the bottom of the container, and a sidewall portion which is generally tubular in shape and being formed integrally with and extending between said upper walled portion and said lower portion, said sidewall portion including a plurality of elongated vertically oriented vacuum panels which are adapted to flex inwardly due to filling and sealing of the container with a liquid at an elevated temperature and subsequent cooling of the liquid, each of said vacuum panels having an upper edge, a lower edge, and a panel portion intermediate said upper and lower edges, said upper edges of said vacuum panels being spaced apart from said upper walled portion defining an upper label mounting area above said vacuum panels, and said lower edges of said vacuum panels being spaced apart from said lower portion defining a lower label mounting area below said vacuum panels, and reinforcement means including first and second reinforcement ribs, said first reinforcement rib extending adjacent to said upper edges of said panels in said label upper mounting area and said second reinforcement rib extending adjacent to said lower edges of said panels in said label lower mounting area, said reinforcement ribs being directed radially inward and extending continuously around the circumference of said sidewall portion, said first and second reinforcement ribs being located in said label upper and lower mounting areas, respectively, spaced apart from the edges of said panels, with said first reinforcement rib being located closer to said panel upper edges than to said upper walled portion and said second reinforcement rib being located closer to said panel lower edges than to said lower portion of said container, and said reinforcement ribs supporting said vacuum panels along their upper and lower edges to hold said supported edges fixed while permitting said panel portions intermediate said edges of said panels to flex inwardly during filling and sealing of the container and resisting deformation of said vacuum panels subsequent to inward flexing of said vacuum panels after filling and sealing of the container.

4. The container according to claim 3, and including a label extending around said container over said vacuum panels and secured to said container in said label upper and lower mounting areas.

5. The container according to claim 3, wherein said reinforcement rib is generally semi-cylindrical in cross section.

6. A thin-walled container formed from a heat set plastic material and adapted to be filled with a liquid at a temperature elevated above room temperature and then sealed, said container comprising: an upper portion which includes a sealable closure and an upper walled portion, a lower portion including a base closing the bottom of the container, and a sidewall portion which is generally tubular in shape and being formed integrally with and extending between said upper walled portion and said lower portion, said sidewall portion including a plurality of elongated vertically oriented vacuum panels which are adapted to flex inwardly upon a lowering of internal pressure during cooling of said liquid, said vacuum panels each having an upper edge, a lower edge, and a panel portion intermediate said upper and lower edges, said upper edges of said vacuum panels being spaced from said container upper walled portion defining a label upper mounting area and said lower edges of said vacuum panels being spaced from said container lower portion defining a label lower mounting area, a first annular reinforcement rib located in said label upper mounting area, and a second annular reinforcement rib located in said label lower mounting area, said first and second reinforcement ribs extending continuously around the inner circumference of said sidewall portion, said first and second reinforcement ribs supporting said vacuum panels at their upper and lower edges, respectively, in such a way as to permit said vacuum panels to flex inwardly upon a lowering of internal pressure during cooling of said liquid and to resist deformation of said vacuum panels subsequent to inward flexing of said vacuum panels after filling and sealing of the container.

7. The container according to claim 6, wherein said first and second reinforcement ribs support said upper and lower edges of said vacuum panels to hold said upper and lower edges fixed relative to said panel portions intermediate said upper and lower edges.

8. The container according to claim 6, wherein said reinforcement ribs are directed radially inward.

9. The container according to claim 6, and including a label extending around said container over said vacuum panels and secured to said container in said label upper and lower mounting areas.

10. A thin-walled container formed from a heat set plastic material and adapted to be filled with a liquid at a temperature elevated above room temperature and then sealed, said container comprising: an upper portion which includes a sealable closure and an upper walled portion, a lower portion including a base closing the bottom of the container, and a sidewall portion which is generally tubular in shape and being formed integrally with and extending between said upper walled portion and said lower portion, said sidewall portion including a plurality of elongated vertically oriented vacuum panels which are adapted to flex inwardly upon a lowering of internal pressure during cooling of said liquid, said vacuum panels each having an upper edge, a lower edge, and a panel portion intermediate said upper and lower edges, said upper edges of said vacuum panels being spaced from said container upper walled portion defining a label upper mounting area and said lower edges of said vacuum panels being spaced from said container lower portion defining a label lower mounting area, a first annular reinforcement rib located in said label upper mounting area, and a second annular reinforcement rib located in said label lower mounting area, said first and second reinforcement ribs extending continuously around the inner circumference of said sidewall portion, said first and second reinforcement ribs supporting said vacuum panels at their upper and lower edges, respectively, in such a way as to permit said vacuum panels to flex inwardly upon a lowering of internal pressure during cooling of said liquid and to resist deformation of said vacuum panels subsequent to inward flexing of said vacuum panels after filling and sealing of the container, said first reinforcement rib being located closer to said upper edges of said vacuum panels than to said upper walled portion and said second reinforcement rib being located closer to said lower edges of said vacuum panels than to said lower portion of the container.

11. A thin-walled container formed from a heat set plastic material and adapted to be filled with a liquid at a temperature elevated above room temperature and then sealed, said container comprising: an upper portion which includes a sealable closure and an upper walled portion, a lower portion including a base closing the bottom of the container, and a sidewall portion which is generally tubular in shape and being formed integrally with and extending between said upper walled portion and said lower portion, said sidewall portion including a plurality of elongated vertically oriented vacuum panels which are adapted to flex inwardly due to filling and sealing of the container with a liquid at an elevated temperature and subsequent cooling of the liquid, said vacuum panels each having an upper edge, a lower edge, and a panel portion intermediate said upper and lower edges, said upper edges of said vacuum panels being spaced from said container upper walled portion defining a label upper mounting area and said lower edges of said vacuum panels being spaced from said container lower portion defining a label lower mounting area, a first annular reinforcement rib located in said label upper mounting area, and a second annular reinforcement rib located in said label lower mounting area, said first and second reinforcement ribs extending continuously around the inner circumference of said sidewall portion, said first and second reinforcement ribs supporting said vacuum panels at their upper and lower edges, respectively, in such a way as to permit said vacuum panels to flex inwardly under hot fill conditions and to resist deformation of said vacuum panels subsequent to inward flexing of said vacuum panels after filling and sealing of the container, wherein said first reinforcement rib merges with said upper edges of said vacuum panels and said second reinforcement rib merges with said lower edges of said vacuum panels.

12. A thin-walled container formed from a heat set plastic material and adapted to be filled with a liquid at a temperature elevated above room temperature and then sealed, said container comprising: an upper portion which includes a sealable closure and an upper walled portion, a lower portion including a base closing the bottom of the container, and a sidewall portion which is generally tubular in shape and being formed integrally with and extending between said upper walled portion and said lower portion, said sidewall portion including a plurality of elongated vertically oriented vacuum panels which are adapted to flex inwardly due to filling and sealing of the container with a liquid at an elevated temperature and subsequent cooling of the liquid, said vacuum panels each having an upper edge, a lower edge, and a panel portion intermediate said upper and lower edges, said upper edges of said vacuum panels being spaced from said container upper walled portion defining a label upper mounting area and said lower edges of said vacuum panels being spaced from said container lower portion defining a label lower mounting area, a first annular reinforcement rib located in said label upper mounting area, and a second annular reinforcement rib located in said label lower mounting area, said first and second reinforcement ribs extending continuously around the inner circumference of said sidewall portion, said first and second reinforcement ribs being directed radially outward, said first and second reinforcement ribs supporting said vacuum panels at their upper and lower edges, respectively, in such a way as to permit said vacuum panels to flex inwardly under hot fill conditions and to resist deformation of said vacuum panels subsequent to inward flexing of said vacuum panels after filling and sealing of the container.

* * * * *